US008690387B2

(12) United States Patent
Ye et al.

(10) Patent No.: US 8,690,387 B2
(45) Date of Patent: Apr. 8, 2014

(54) LAMP MODULE AND DESK LAMP USING THE SAME

(75) Inventors: Zhi-Ting Ye, Zaociao Township, Miaoli County (TW); Kuo-Jui Huang, Taichung (TW); Hsiu-Ping Lee, Taichung (TW)

(73) Assignees: Dongguan Masstop Liquid Crystal Display Co., Ltd., Dongguan, Guangdong Province (CN); Wintek Corporation, Taichung (TW)

( * ) Notice: Subject to any disclaimer, the term of this patent is extended or adjusted under 35 U.S.C. 154(b) by 369 days.

(21) Appl. No.: 13/182,949

(22) Filed: Jul. 14, 2011

(65) Prior Publication Data

US 2012/0014103 A1 Jan. 19, 2012

(30) Foreign Application Priority Data

Jul. 15, 2010 (TW) ..... 99123353 A

(51) Int. Cl.
*F21V 21/00* (2006.01)

(52) U.S. Cl.
USPC ..... 362/249.02; 362/410; 362/414

(58) Field of Classification Search
USPC ..... 362/236–240, 249.01, 249.02, 249.06, 362/249.14, 410, 414, 431, 249.03, 249.07, 362/249.1
See application file for complete search history.

(56) References Cited

U.S. PATENT DOCUMENTS

| | | | | |
|---|---|---|---|---|
| 2003/0189835 | A1* | 10/2003 | Tsukamoto | 362/475 |
| 2007/0247833 | A1* | 10/2007 | Lee et al. | 362/97 |
| 2010/0053496 | A1* | 3/2010 | Park et al. | 349/61 |
| 2010/0124064 | A1* | 5/2010 | Ogawa et al. | 362/307 |

FOREIGN PATENT DOCUMENTS

| | | | |
|---|---|---|---|
| CN | 101551080 | A | 10/2009 |
| TW | M298078 | | 9/2006 |
| TW | 200739993 | A | 10/2007 |
| TW | M341153 | | 9/2008 |
| TW | 200909730 | A | 3/2009 |
| TW | M358245 | | 6/2009 |
| TW | M362928 | | 8/2009 |
| TW | M362968 | | 8/2009 |
| TW | M367387 | | 10/2009 |

OTHER PUBLICATIONS

English language translation of abstract of TW M358245 (published Jun. 1, 2009).
English language translation of abstract of TW M362928 (published Aug. 11, 2009).
English language translation of abstract of TW M362968 (published Aug. 11, 2009).
English language translation of abstract of TW M367387 (published Oct. 21, 2009).
English abstract translation of CN101551080 (Published Oct. 7, 2009).

(Continued)

*Primary Examiner* — Thomas Sember
(74) *Attorney, Agent, or Firm* — McClure, Qualey & Rodack, LLP

(57) ABSTRACT

A lamp module is provided. The lamp module includes a main body and a plurality of light emitting diodes. The light emitting diodes are disposed on the main body. Each light emitting diode emits a light to a illuminated region and form a corresponding light region. The light regions formed on the illuminated region by the light emitted by adjacent light emitting diodes are at least partially overlapped.

9 Claims, 3 Drawing Sheets

(56) References Cited

OTHER PUBLICATIONS

TW Office Action dated Jan. 14, 2013.
TW Office Action dated May 5, 2013.
English Abstract translation of TW200909730 (Published Mar. 1, 2009).
English Abstract translation of TWM298078 (Published Sep. 21, 2006).
English Abstract translation of TWM341153 (Published Sep. 21, 2008).
English Abstract translation of TW200739993 (Listed in Foreign Reference, Published Oct. 16, 2007).

* cited by examiner

LAMP MODULE AND DESK LAMP USING THE SAME

This application claims the benefit of Taiwan application Serial No. 99123353, filed Jul. 15, 2010, the subject matter of which is incorporated herein by reference.

BACKGROUND OF THE INVENTION

1. Field of the Invention

The invention relates in general to a lamp module and a desk lamp using the same, and more particularly to a lamp module and a desk lamp using the same capable of reducing manufacturing cost.

2. Description of the Related Art

The lamp module has gained a wide range of application in people's everyday life, such as the lamp signs on computer casing, the traffic light and the decoration lamps of department stores, and can be seen everywhere. As the awareness of power saving is rising and the demand for the lamp module is increasing, how to provide a lamp module capable of reducing manufacturing materials and power consumption and at the same time maintaining the luminance level has thus become an imminent task for the industries.

SUMMARY OF THE INVENTION

The invention is directed to a lamp module and a desk lamp using the same capable of saving power consumption and reducing manufacturing cost through the design in the disposition of the light emitting diodes.

According to an aspect of the invention, a lamp module including a main body and a plurality of light emitting diodes (LED) is provided. The light emitting diodes are disposed on the main body. Each light emitting diode emits a light to an illuminated region and respectively forms a corresponding light region on the illuminated region. The light regions formed on the illuminated region by the light emitted by adjacent light emitting diodes are at least partially overlapped.

According to another aspect of the invention, a desk lamp including a lamp module and a lamp base module is provided. The lamp module includes a main body and a plurality of light emitting diodes. The main body has a central region. The light emitting diodes are disposed on the main body. Each light emitting diode emits a light to an illuminated region and forms a light region on the illuminated region. The light regions formed on the illuminated region by the light emitted by adjacent light emitting diodes are at least partially overlapped. The light emitting diodes includes at least one first light emitting diode and a plurality of second light emitting diodes. The at least one first light emitting diode is disposed within the central region of the main body. The second light emitting diodes are disposed on the part of the main body near the edge of the main body and located outside the first light emitting diodes, wherein a first light-distribution full angle of the light emitted by any first light emitting diode is smaller than a second light-distribution full angle of the light emitted by any second light emitting diode. A lamp base module is connected to the lamp module. The first and the second light emitting diodes emit a light at the same time so that the luminance at the part of the illuminated region closer to a central portion is higher than the luminance at the part farther away from the central portion.

The above and other aspects of the invention will become better understood with regard to the following detailed description of the preferred but non-limiting embodiment(s). The following description is made with reference to the accompanying drawings.

DETAILED DESCRIPTION OF THE INVENTION

First Embodiment

Figure 1:
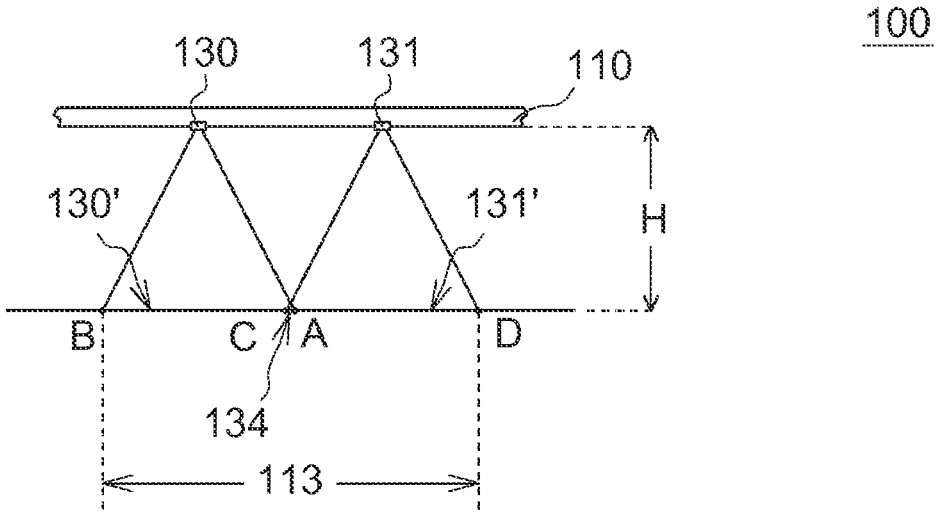
FIG. 1 shows a lamp module according to a first embodiment of the disclosure.

Referring to FIG. 1, a lamp module according to a first embodiment of the disclosure is shown. The lamp module 100 includes a main body 110 and a plurality of light emitting diodes (LED) 130 and 131. The light emitting diodes 130 and 131 are disposed on the main body 110. Each light emitting diode emits a light to an illuminated region 113 and respectively forms a corresponding light region on the illuminated region 113. The light regions formed on the illuminated region 113 by the light emitted by adjacent light emitting diodes are at least partially overlapped.

In the embodiment, as indicated in FIG. 1, the light emitting diodes 130 emits a light and forms a light region 130' on the illuminated region 113, wherein the light region 130' has boundaries A and B. Likewise, the light emitting diodes 131 emits a light and forms a light region 131' on the illuminated region 113, wherein the light region 131' has boundaries C and D. Thus, the illuminated region 113 is within the region between boundaries B and D. The boundary C is located between the boundaries A and B, and the boundary A is located between boundaries C and D. Thus, the light regions 130' and 131' formed on the illuminated region 113 by the light emitted by the light emitting diodes 130 and 131 respectively are overlapped and form an overlapping light region 134, that is, the region between the boundaries A and C. If the area of the illuminated region 113 is to be maximized, then the area of the light overlapping region 134 needs to be minimized. If the area with high luminance is to be maximized, then the area of the light overlapping light region 134 needs to be maximized. In general, the vertical distance H between the light emitting diodes 130, 131 and the illuminated region 113 is substantially smaller than 1 meter so as to achieve the better effect of illumination. In an example of application, the quantity of the light emitting diodes is not limited to the quantity illustrated in the diagram. Any designs are within the scope of protection of the disclosure as long as the disposition of the light emitting diodes is conformed to the spirit and scope of the disclosure.

Second Embodiment

Figure 2:
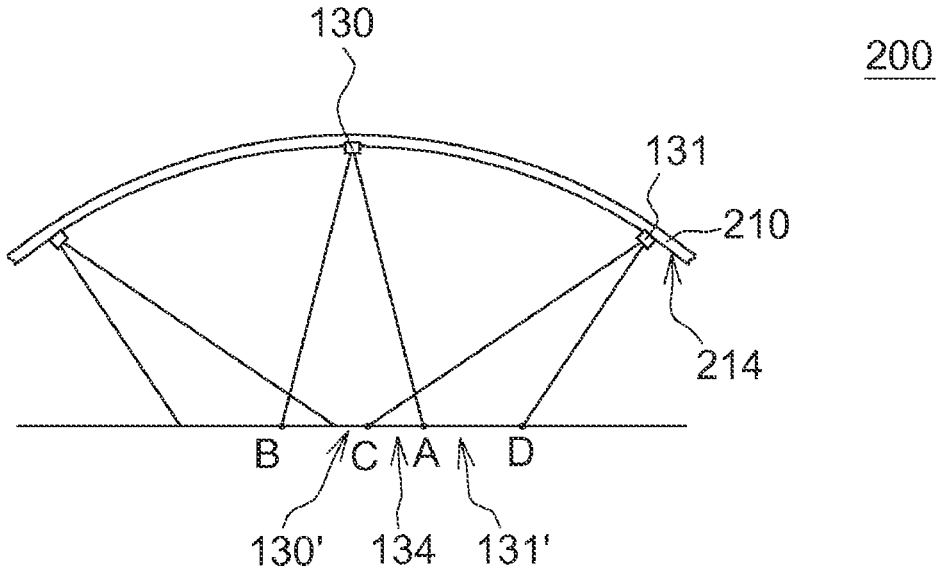
FIG. 2 shows a lamp module according to a second embodiment of the disclosure.

Referring to FIG. 2, a lamp module according to a second embodiment of the disclosure is shown. The present embodiment of the disclosure is different from the first embodiment in that the main body 210 of the lamp module 200 has a curved surface 214 on which the light emitting diodes 130 and 131 are disposed. The main body 210 can be made from metal core PCB (MCPCB) or other flexible material, so that the bending degree of the main body 210 can be determined according to the light-distribution angles of the light emitting diodes. For example, if wider region which has higher luminance within the central part of the illuminated region 113 is required, then the main body 210 can be adjusted to an appropriate bending, so that the area of the light overlapping region 134 of the light regions 130' and 131' formed on the illuminated region 113 by the light emitted by the light emitting diodes 130 and 131 respectively is maximized, and vice versa. The remaining parts are similar to the first embodiment, and the similarities are not repeated here.

Third Embodiment

Figure 3:
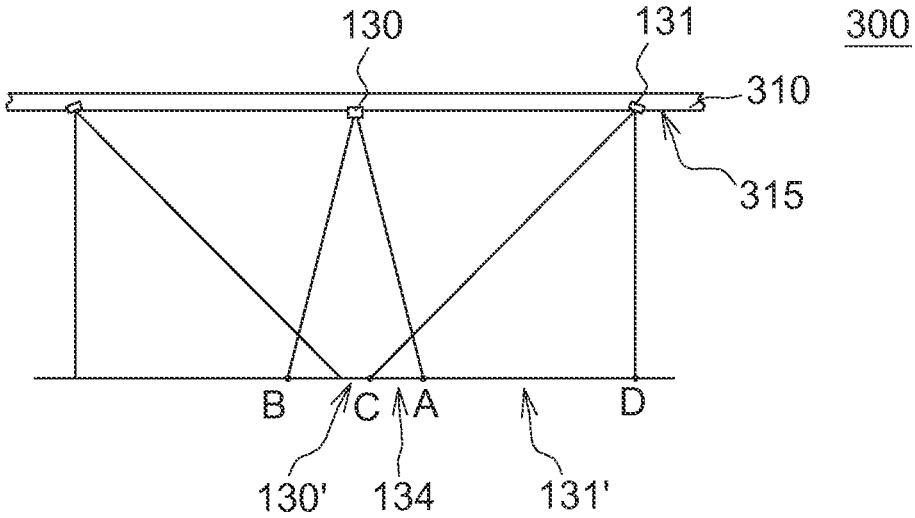
FIG. 3 shows a lamp module according to a third embodiment of the disclosure.

Referring to FIG. 3, a lamp module according to a third embodiment of the disclosure is shown. The present embodiment of the disclosure is different from the first embodiment in that the main body 310 of the lamp module 300 has a plane 315 on which the light emitting diodes 130 and 131 are disposed on, and the light emitting diodes 130 and 131 can be rotated for adjusting their radiation directions to achieve predetermined effects of illumination. For example, if wider region which has higher luminance within the central part of the illuminated region 113 is required, then the light emitting diodes 130 and 131 can be rotated for adjusting their radiation directions so that the area of the light overlapping region 134 of the light regions 130' and 131' formed on the illuminated region 113 by the light emitted by the light emitting diodes 130 and 131 respectively is maximized, and vice versa. The remaining parts are similar to the first embodiment, and the similarities are not repeated here.

Fourth Embodiment

Figure 4A:
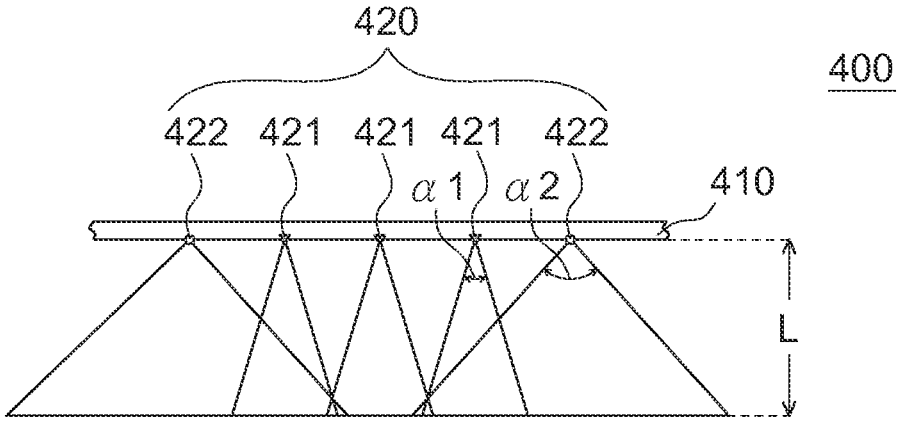
FIG. 4A shows a lamp module according to a fourth embodiment of the disclosure.
Figure 4B:
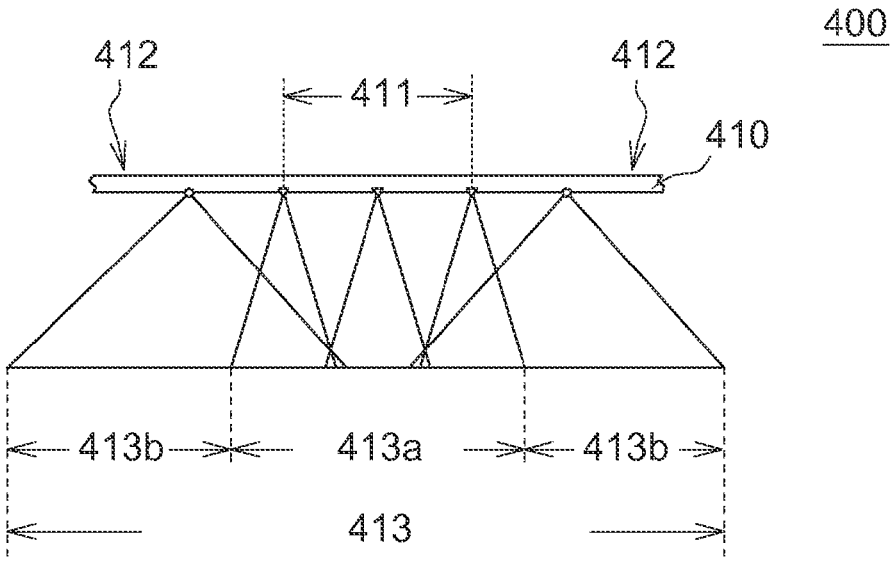
FIG. 4B is another diagram illustrating the lamp module of FIG. 4A.

Referring to FIG. 4A and FIG. 4B, FIG. 4A shows a lamp module according to a fourth embodiment of the disclosure. FIG. 4B is another diagram illustrating the lamp module of FIG. 4A. The lamp module 400 includes a main body 410 and a plurality of light emitting diodes (LED) 420. The main body 410 has a central region 411. The light emitting diodes 420 are disposed on the main body 410. Each light emitting diode 420 emits a light to an illuminated region 413, and respectively forms a corresponding light region on the illuminated region 413. The light regions formed on the illuminated region 413 by the light emitted by adjacent light emitting diodes 420 are at least partially overlapped. The elaborations of the light regions formed on the illuminated region by the light emitted by adjacent light emitting diodes being at least partially overlapped are similar to the first embodiment, and the similarities are not repeated here.

In the present embodiment of the disclosure, the light emitting diodes 420 includes at least one light emitting diode 421 and a plurality of light emitting diodes 422. The at least one light emitting diodes 421 is disposed within the central region 411 on the main body 410. The light emitting diodes 422 are disposed on the part of the main body 410 near the edge 412 of the main body 410 and located outside the light emitting diodes 421, and a light-distribution full angle $\alpha 1$ of the light emitted by any light emitting diode 421 is smaller than a light-distribution full angle $\alpha 2$ of the light emitted by any light emitting diode 422. The light emitting diodes 421 and 422 emit light at the same time so that the luminance at the part of the illuminated region 413 closer to a central portion 413*a* is higher than the luminance at the part farther away from the central portion 413*a*.

The light emitting diodes 420 are further elaborated below. In the present embodiment of the disclosure, the light emitting diodes 420 include at least one beam-focused light emitting diode 421 and a plurality of wide-angle light emitting diodes 422. For example, as indicated in FIG. 4A, the light emitting diodes 420 include three beam-focused light emitting diodes 421 and two wide-angle light emitting diodes 422. The light-distribution full angle $\alpha 1$ of the beam-focused light emitting diode 421 is substantially smaller than or equal to 60 degrees, and the light-distribution full angle $\alpha 2$ of the wide-angle light emitting diode 422 is substantially larger than or equal to 100 degrees. As illustrated in FIG. 4B and FIG. 4A, the beam-focused light emitting diodes 421 are disposed within the central region 411 which is relative close to the center on the main body 410, and the wide-angle light emitting diodes 422 are disposed outside the beam-focused light emitting diodes 421 and near the edge 412 of the main body 410.

The light-distribution full angles of the light emitting diodes used in a conventional lamp module are of the same type and thus incur more manufacturing cost, not only requiring an additional film, such as diffusion film or prism film, but also failing to make the luminance at the central portion of the illuminated region higher than the luminance at the peripheral.

According to the lamp module of the present embodiment of the disclosure, the beam-focused light emitting diodes 421 are disposed within the central region 411 on the main body 410, so that the light emitted by the beam-focused light emitting diodes 421 directly radiates the central portion 413*a* of the illuminated region 413. In other words, the central portion 413*a* of the illuminated region 413 is defined by the light region formed on the illuminated region 413 formed by the light emitted by the beam-focused light emitting diodes 421. In addition, since the area radiated by the wide-angle light emitting diodes 422 is larger, the wide-angle light emitting diodes 422 are disposed outside the beam-focused light emitting diodes 421 and near the edge 412 of the main body 410, so that the radiation area can be extended to the central portion 413*a* of the illuminated region 413. Since the light emitted by the beam-focused light emitting diodes 421 and the wide-angle light emitting diodes 422 all radiate the central portion 413*a* of the illuminated region 413, the luminance at the central portion 413*a* of the illuminated region 113 is higher than the luminance at the peripheral 413*b* surrounding the central portion 413*a* on the illuminated region 113. Moreover, the above disposition does not require additional optical film, and is therefore advantages in terms of cost.

In general, the distance L between the light emitting diodes 420 and the illuminated region 413 is substantially smaller than 1 meter so as to achieve the better effect of illumination. In an example of application, the quantity of the light emitting diodes is not limited to the quantity illustrated in the diagram. Any designs are within the scope of protection of the disclosure as long as the disposition of the light emitting diodes is conformed to the spirit and scope of the disclosure.

Example of Application

Figure 5:
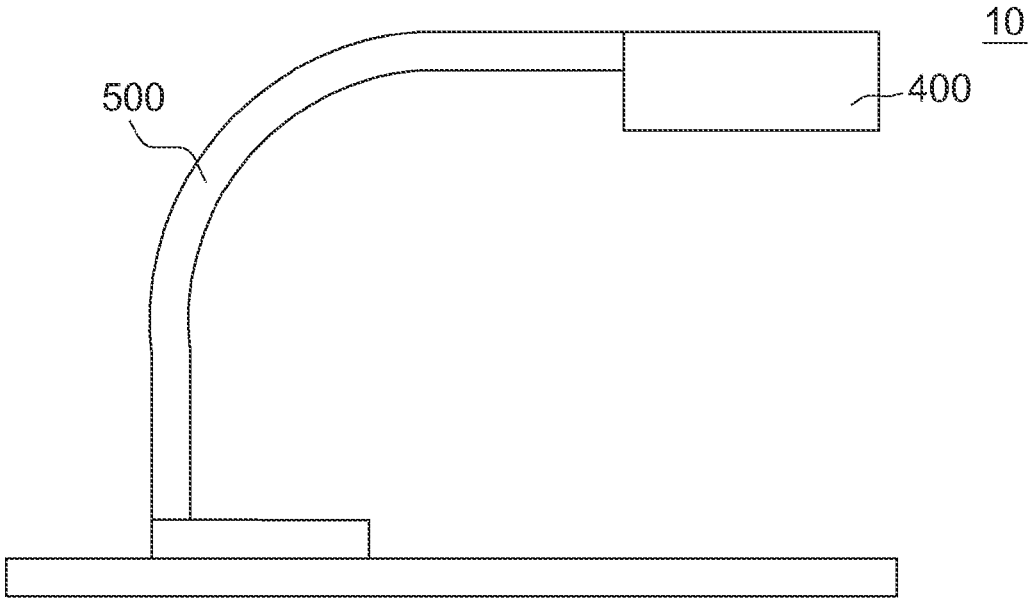
FIG. 5 shows a desk lamp using the lamp module of the embodiment of the disclosure.

In the fourth embodiment, the lamp module 400, having higher luminance at the part closer to the central portion 413*a* of the illuminated region 413 than the luminance at the peripheral 413*b* away from the central portion, is adaptable to the illumination apparatus (such as desk lamp, surgical light and flashlight) which requires higher luminance at the central portion. Referring to FIG. 5, a desk lamp using the lamp module of the embodiment of the disclosure is shown. The desk lamp 10 includes a lamp module 400 and a lamp base module 500. The lamp module 400 is similar to the lamp module of the fourth embodiment, and the similarities not repeated here. The lamp base module 500 is connected to the lamp module 400 for supporting the lamp module 400 so that a suitable vertical distance is created between the lamp module 400 and the target of illumination, wherein the vertical distance is substantially smaller than 1 meter.

According to the lamp module and the desk lamp using the same disclosed in the above embodiments of the disclosure, the luminance at the part of an illuminated region closer to the central portion is higher than the luminance at the peripheral away from the central portion through designing in the disposition of the beam-focused light emitting diodes and the wide-angle light emitting diodes. Furthermore, several radiation results can be achieved provided that the main body is flexible or that the light emitting diodes can be rotated for adjusting their radiation directions. Moreover, the lamp module of the disclosure can dispense with the use of films such as diffusing film or prism film capable of diffusing or focusing the light so that the manufacturing cost of the lamp module can be further reduced. In comparison to the design in which all light emitting diodes are wide-angle light emitting diodes, the lamp module of the disclosure achieves power saving by the way of disposing the beam-focused light emitting diodes in the part closer to the central portion of the main body so that the luminance at the central region of the illuminated region is not affected. In terms of application, the lamp module suitable to the illumination apparatus (such as desk lamp, surgical light and flashlight) which requires higher luminance at the central portion. Thus, the embodiments of the disclosure, having the advantages of environmental conservation, power saving, versatile design, low manufacturing cost and wide range of application, are indeed valuable to the industries.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A lamp module, comprising:

a main body having a central region; and a plurality of light emitting diodes disposed on the main body, wherein the light emitting diodes comprise at least one first light emitting diode disposed within the central region of the main body, and each light emitting diode emits a light to an illuminated region and respectively forms a corresponding light region on the illuminated region;

wherein the light regions formed on the illuminated region by the light emitted by adjacent light emitting diodes are at least partially overlapped, and the light emitting diodes emit light at the same time so that the luminance at the part of the illuminated region closer to a central portion is higher than the luminance at the part farther away from the central portion;

wherein the light emitting diodes further comprise a plurality of second light emitting diodes disposed on the part of the main body near the edge of the main body and located outside the first light emitting diodes, and a first light-distribution full angle of the light emitted by any first light emitting diode is smaller than a second light-distribution full angle of the light emitted by any second light emitting diode.

2. The lamp module according to claim 1, wherein the first light-distribution full angles of the light emitted by the first light emitting diodes are the same, and the second light-distribution full angles of the light emitted by the second light emitting diodes are also the same.

3. The lamp module according to claim 1, wherein the first light-distribution full angle of the light emitted by any first light emitting diode is substantially smaller than or equal to 60 degrees.

4. The lamp module according to claim 1, wherein the second light-distribution full angle of the light emitted by any second light emitting diode is substantially larger than or equal to 100 degrees.

5. The lamp module according to claim 1, wherein a vertical distance between the light emitting diodes and the illuminated region is substantially smaller than 1 meter.

6. The lamp module according to claim 1, wherein the main body has a curved surface on which the light emitting diodes are disposed.

7. The lamp module according to claim 1, wherein the main body has a plane on which the light emitting diodes are disposed and the light emitting diodes are rotatable.

8. The lamp module according to claim 1, wherein the main body is realized by a metal core PCB (MCPCB).

9. A desk lamp, comprising:

a lamp module, comprising:

a main body having a central region; and a plurality of light emitting diodes disposed on the main body, wherein each light emitting diode emits a light to an illuminated region and respectively forms a light region on the illuminated region, the light regions formed on the illuminated region by the light emitted by adjacent light emitting diodes are at least partially overlapped, and the light emitting diodes comprise:

at least one first light emitting diode disposed within the central region of the main body; and a plurality of second light emitting diodes disposed on the part of the main body near the edge of the main body and located outside the first light emitting diodes, wherein a first light-distribution full angle of the light emitted by any first light emitting diode is smaller than a second light-distribution full angle of the light emitted by any second light emitting diode; and a lamp base module connected to the lamp module;

wherein the first and the second light emitting diodes emit light at the same time so that the luminance at the part of the illuminated region closer to a central portion is higher than the luminance at the part farther away from the central portion.

* * * * *